US012435383B2

(12) United States Patent
Kim et al.

(10) Patent No.: US 12,435,383 B2
(45) Date of Patent: Oct. 7, 2025

(54) HIGH STRENGTH MULTI-PHASE STEEL HAVING EXCELLENT BURRING PROPERTIES AT LOW TEMPERATURE, AND METHOD FOR PRODUCING SAME

(71) Applicant: POSCO, Pohang-si (KR)

(72) Inventors: Sung-Il Kim, Gwangyang-si (KR); Seok-Jong Seo, Gwangyang-si (KR); Hyun-Taek Na, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 372 days.

(21) Appl. No.: 16/467,226

(22) PCT Filed: Nov. 23, 2017

(86) PCT No.: PCT/KR2017/013408
§ 371 (c)(1),
(2) Date: Jun. 6, 2019

(87) PCT Pub. No.: WO2018/110853
PCT Pub. Date: Jun. 21, 2018

(65) Prior Publication Data

US 2020/0080167 A1 Mar. 12, 2020

(30) Foreign Application Priority Data

Dec. 13, 2016 (KR) ..... 10-2016-0169718

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/002* (2013.01); *C21D 6/005* (2013.01); *C21D 6/008* (2013.01);
(Continued)

(58) Field of Classification Search
CPC ..... C21D 9/46; C21D 8/0205; C21D 8/0226
See application file for complete search history.

(56) References Cited

U.S. PATENT DOCUMENTS 6,221,179 B1 * 4/2001 Yasuhara ..... C21D 8/0226 148/333
6,709,534 B2 3/2004 Kusinski et al.
(Continued)

FOREIGN PATENT DOCUMENTS

CN 102747272 A * 10/2012
CN 103328671 9/2013
(Continued)

OTHER PUBLICATIONS

CN-102747272-A, Guhui Gao; Qingzhi Shi; Wenli Liu; Zhunli Tan, English Translation obtained from EPO, 2012 (Year: 2012).*
(Continued)

*Primary Examiner* — Keith Walker
(74) *Attorney, Agent, or Firm* — CANTOR COLBURN LLP

(57) ABSTRACT

Provided is a high strength multi-phase steel having excellent burring properties at low temperature, and a method for producing the same. More specifically, provided are a high strength multi-phase steel having excellent burring properties at low temperature, and a method for producing the same, wherein the multi-phase steel can be appropriately used as a member, a lower arm, a reinforcement material, a connection material, or the like for a vehicle chassis component.

2 Claims, 1 Drawing Sheet

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *C21D 8/0205* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | | |
|---|---|---|---|---|
| 9,188,253 | B2 * | 11/2015 | Sawamura | C22C 38/06 |
| 2009/0136378 | A1 | 5/2009 | Satou et al. | |
| 2014/0000766 | A1 | 1/2014 | Maeda et al. | |
| 2014/0007993 | A1 | 1/2014 | Nakajima et al. | |
| 2014/0352850 | A1 * | 12/2014 | Kondo | C22C 38/50 148/504 |
| 2015/0203946 | A1 | 7/2015 | Hammer et al. | |
| 2016/0017465 | A1 | 1/2016 | Toda et al. | |

FOREIGN PATENT DOCUMENTS

| | | | |
|---|---|---|---|
| CN | 103510008 | | 1/2014 |
| EP | 1577412 | | 9/2005 |
| EP | 3050989 | | 8/2016 |
| JP | 06293910 | | 10/1994 |
| JP | 2000239791 | | 9/2000 |
| JP | 2001342538 | A * | 12/2001 |
| JP | 2005307339 | | 11/2005 |
| JP | 2006274335 | | 10/2006 |
| JP | 2011012308 | | 1/2011 |
| JP | 4776167 | | 9/2011 |
| JP | 2013194316 | | 9/2013 |
| JP | 6154010 | | 6/2017 |
| KR | 101114672 | | 3/2012 |
| KR | 20120074807 | | 7/2012 |
| KR | 20130080038 | | 7/2013 |
| KR | 20130116329 | | 10/2013 |
| WO | 2012128206 | | 9/2012 |
| WO | 2014171427 | | 10/2014 |
| WO | 2015/099222 | | 7/2015 |

OTHER PUBLICATIONS

Antonio Augusto Gorni, Jose Herbert Dolabela da Silveira, Accelerated Cooling of Steel Plates: The Time Has Come, 2008, Journal of ASTM International, vol. 5, No. 8 (Year: 2008).*

European Search Report—Application No. 17880227.8 dated Aug. 16, 2019, citing WO 2015/099222, EP 3 050 989, EP 1 577 412, and KR 2013 0116329.

Chinese Office Action—Chinese Application No. 201780077012.6 issued on Aug. 5, 2020, citing CN 103328671, CN 103510008, WO 2015/099222, and JP 2000-239791.

Japanese Office Action—Japanese Application No. 2019-531320 issued on Jul. 28, 2020, citing WO 2012/128206, WO 2014/171427, and WO 2015/099222.

Japanese Rejection Notification—Japanese Application No. 2019-531320 issued on Jan. 26, 2021, citing JP 4776167 and JP 6154010.

International Search Report—PCT/KR2017/013408 dated Mar. 23, 2018.

* cited by examiner

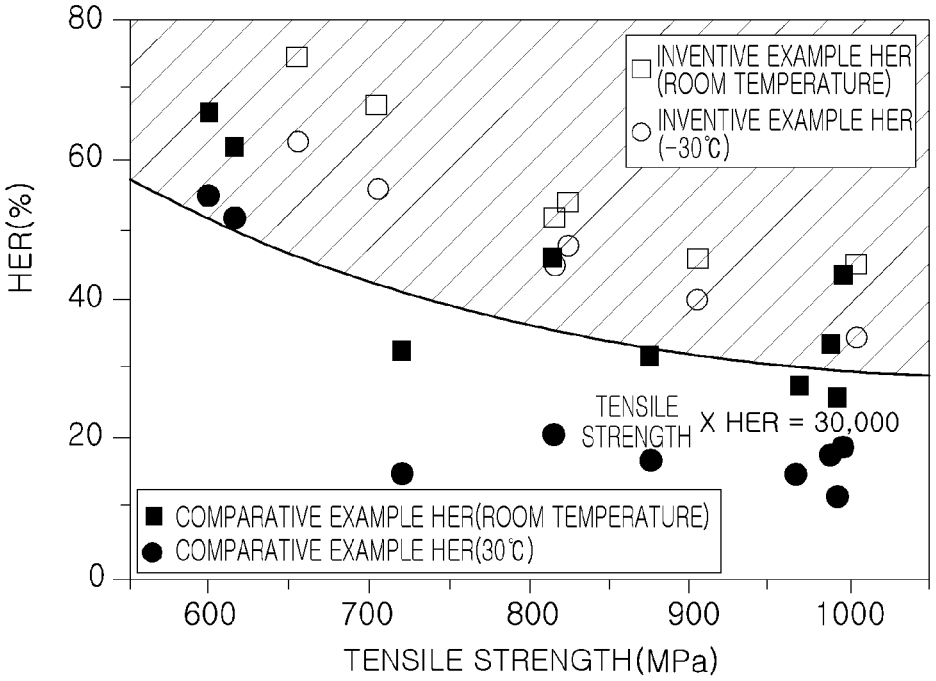
80
60
40
20
0
HER(%)
600
700
800
900
1000
TENSILE STRENGTH(MPa)
INVENTIVE EXAMPLE HER (ROOM TEMPERATURE)
INVENTIVE EXAMPLE HER (-30℃)
TENSILE STRENGTH X HER = 30,000
COMPARATIVE EXAMPLE HER(ROOM TEMPERATURE)
COMPARATIVE EXAMPLE HER(30℃)

HIGH STRENGTH MULTI-PHASE STEEL HAVING EXCELLENT BURRING PROPERTIES AT LOW TEMPERATURE, AND METHOD FOR PRODUCING SAME

TECHNICAL FIELD

The present disclosure high strength multi-phase steel having excellent burring properties at low temperature, and a method for producing the same. More specifically, the present disclosure relates to high strength multi-phase steel having excellent burring properties at low temperature, and a method for producing the same, wherein the multi-phase steel may be appropriately used as a member, a lower arm, a reinforcement material, a connection material, or the like for a vehicle chassis component.

BACKGROUND ART

In general, two-phase ferrite-bainite multi-phase steel may be mainly used as a hot-rolled steel sheet for an automobile chassis component, and examples of art related thereto are Patent Documents 1 to 3. The alloying elements such as silicon (Si), manganese (Mn), aluminum (Al), molybdenum (Mo), and chromium (Cr), mainly used to produce such multi-phase steel, may be effective in improving strength and stretch flangeability of hot-rolled steel sheets. However, when they are added in excessively amounts, segregation of alloy components and ununiformity of a microstructure may be caused, such that the stretch flangeability may deteriorate. Especially, steel having a relatively high hardenability may be susceptible to microstructural changes depending on cooling conditions. When a low temperature transformed structure phase is formed ununiformly, the stretch flangeability may deteriorate. In addition, when precipitate forming elements such as titanium (Ti), niobium (Nb), and vanadium (V) are excessively used to obtain high strength, a rolling load may increase due to delay of recrystallization of the steel during a hot-rolling operation. Therefore, it may be difficult to produce a relatively thin product, and formability may also deteriorate. In addition, since the content of C and N dissolved in the steel may decrease, it may be difficult to obtain a relatively high bake hardenability (BH) value, and it may be economically disadvantageous.

(Patent Document 1) Japanese Patent Publication No. 06-293910

(Patent Document 2) Korean Patent No. 10-1114672

(Patent Document 3) Korean Patent Publication No. 10-2013-7009196

DISCLOSURE

Technical Problem

An aspect of the present disclosure is to provide high strength multi-phase steel having excellent burring properties at low temperature, and a method for producing the same.

Technical Solution

According to an aspect of the present disclosure, high strength multi-phase steel includes, by weight, carbon (C): 0.05% to 0.14%, silicon (Si): 0.01% to 1.0%, manganese (Mn): 1.0% to 3.0%, aluminum (Al): 0.01% to 0.1%, chromium (Cr): 0.005% to 1.0%, molybdenum (Mo): 0.003% to 0.3%, phosphorus (P): 0.001% to 0.05%, sulfur (S): 0.01% or less, nitrogen (N): 0.001% to 0.01%, niobium (Nb): 0.005% to 0.06%, titanium (Ti): 0.005% to 0.13%, vanadium (V): 0.003% to 0.2%, boron (B): 0.0003% to 0.003%, a remainder of iron (Fe), and other inevitable impurities, wherein [C]* defined by the following Equations 1 and 2 is 0.022 or more and 0.10 or less, in a microstructure of the high strength multi-phase steel, the sum of area ratios of ferrite and bainite is 97% to 99%, an area ratio of martensite and austenite (MA) is 1% to 3%, the number of austenite structures having a diameter of 10 μm or more per a unit area is $1\times10^4/cm^2$ or less (including $0/cm^2$), and the number of austenite structures having a diameter of less than 10 μm per a unit area is $1\times10^8/cm^2$ or more:

$$[C]^*=([C]+[N])-([C]+[N])\times S \quad \text{[Equation 1]}$$

$$S=([Nb]/93+[Ti]/48+[V]/51+[Mo]/96)/([C]/12+[N]/14) \quad \text{[Equation 2]}$$

where each of [C], [N], [Nb], [Ti], [V], and [Mo] refers to a weight percentage (wt %) of the element.

According to another aspect of the present disclosure, a method for producing high strength multi-phase steel includes: reheating a slab comprising, by weight, carbon (C): 0.05% to 0.14%, silicon (Si): 0.01% to 1.0%, manganese (Mn): 1.0% to 3.0%, aluminum (Al): 0.01% to 0.1%, chromium (Cr): 0.005% to 1.0%, molybdenum (Mo): 0.003% to 0.3%, phosphorus (P): 0.001% to 0.05%, sulfur (S): 0.01% or less, nitrogen (N): 0.001% to 0.01%, niobium (Nb): 0.005% to 0.06%, titanium (Ti): 0.005% to 0.13%, vanadium (V): 0.003% to 0.2%, boron (B): 0.0003% to 0.003%, a remainder of iron (Fe), and other inevitable impurities, and satisfying the following Relationship 1, wherein [C]* defined by the following Equations 1 and 2 is 0.022 or more and 0.10 or less; hot-rolling the reheated slab to obtain a hot-rolled steel sheet; firstly cooling the hot-rolled steel sheet to a first cooling end temperature of 500° C. to 700° C. at a rate of 10° C./sec to 70° C./sec; air-cooling the firstly cooled hot-rolled steel sheet at the first cooling end temperature for 3 to 10 seconds; secondly cooling the air-cooled hot-rolled steel sheet to a second cooling end temperature of 400° C. to 550° C. at a rate of 10° C./sec to 70° C./sec; coiling the secondly cooled hot-rolled steel sheet at the second cooling end temperature; and thirdly cooling the coiled hot-rolled steel sheet to 200° C. or less at a rate of 25° C./hour or less (excluding 0° C./hour):

$$[C]^*=([C]+[N])-([C]+[N])\times S \quad \text{[Equation 1]}$$

$$S=([Nb]/93+[Ti]/48+[V]/51+[Mo]/96)/([C]/12+[N]/14) \quad \text{[Equation 2]}$$

$$[Mn]+2.8[Mo]+1.5[Cr]+500[B]\leq 4.0 \quad \text{[Relationship 1]}$$

where each of [C], [N], [Nb], [Ti], [V], [Mo], [Mn], [Cr], and [Mo] refers to a weight percentage (wt %) of the element.

Advantageous Effects

According to an aspect of the present disclosure, high strength multi-phase steel according to the present disclosure has an advantage of having excellent burring properties at low temperature.

The various and advantageous advantages and effects of the present disclosure are not limited to the above description, and can be more easily understood in the course of describing specific embodiments of the present disclosure.

DESCRIPTION OF DRAWINGS

FIG. 1 is a graph showing relationships between tensile strength and Hole Expanding Ratio (HER) of inventive and comparative examples.

BEST MODE FOR INVENTION

Hereinafter, high strength multi-phase steel having excellent burring properties at low temperature, which may be one aspect of the present disclosure, will be described in detail.

First, the alloy components and the preferable content range of the high strength multi-phase steel of the present disclosure will be described in detail. It is noted that the content of each component described below is based on weight, unless otherwise specified.

C: 0.05% to 0.14%

C may be the most economical and effective element for strengthening steel. As the content thereof increases, the tensile strength may increase by the precipitation strengthening effect or the bainite fraction increasing effect. In order to obtain such an effect in the present disclosure, it is preferable to be contained in an amount of 0.05% or more. When the content thereof is excessive, a large amount of martensite may be formed, to excessively increase strength, deteriorate formability and impact resistance, and deteriorate weldability. In order to prevent this, an upper limit of the C content is preferably limited to 0.14%, more preferably to 0.12%, and even more preferably to 0.10%.

Si: 0.01% to 1.0%

Si may play roles of deoxidizing molten steel, improving strength of steel by solid solution strengthening, delaying formation of coarse carbides, and improving formability. In order to obtain such effects in the present disclosure, it is preferable that the content thereof is 0.01% or more. When the content thereof is excessive, a red color scale due to Si may be formed on the surface of the steel sheet during a hot-rolling operation, which not only deteriorates surface quality of the steel sheet, but also deteriorates ductility and weldability of the steel sheet. In order to prevent this, it is preferable to restrict an upper limit of the Si content to 1.0%.

Mn: 1.0% to 3.0%

Mn, like Si, may be an effective element for solid solution strengthening the steel, and may enhance the hardenability of the steel to facilitate formation of bainite during a cooling operation, after a hot-rolling operation. In order to obtain such effects in the present disclosure, the content thereof is preferably 1.0% or more, more preferably 1.2% or more. When the content thereof is excessive, there may be problems that the hardenability may greatly increase, martensite transformation may easily occur, the microstructure may be unevenly formed in the plate thickness direction, and the stretch flangeability may deteriorate. In order to prevent this, an upper limit of the Mn content is preferably limited to 3.0%, more preferably to 2.5%.

Al: 0.01% to 0.1%

Al may be a component mainly added for deoxidation, and it is preferable that Al may be contained in an amount of 0.01% or more to expect a sufficient deoxidizing effect. When the content thereof is excessive, AlN may be formed in association with nitrogen, such that corner cracks may be likely to occur in a slab during a continuous casting operation, and defects due to formation of inclusions may be likely to occur. In order to prevent this, an upper limit of the content of Al is preferably limited to 0.1%, more preferably to 0.06%.

Cr: 0.005% to 1.0%

Cr may play roles of solid solution strengthening the steel, delaying the phase transformation of ferrite during a cooling operation, and helping to form bainite. In order to obtain such an effect in the present disclosure, the content thereof is preferably 0.005% or more, more preferably 0.008% or more. When the content thereof is excessive, the ferrite transformation may be excessively delayed to form martensite, thereby deteriorating the ductility of the steel. In addition, similar to Mn, a segregation portion may be greatly developed in a central portion of the plate thickness, and a microstructure in the thickness direction may be made ununiformly, and the stretch flangeability may deteriorate. In order to prevent this, an upper limit of the Cr content is preferably limited to 1.0%, more preferably to 0.8%.

Mo: 0.003% to 0.3%

Mo may increase the hardenability of the steel to facilitate bainite formation. In order to obtain such effects in the present disclosure, it is preferable that the content thereof may be 0.003% or more. When the content thereof is excessive, martensite may be formed due to an increase in the quenchability, and the formability may rapidly deteriorate, which may be also disadvantageous in terms of economy and weldability. In order to prevent this, an upper limit of the Mo content is preferably limited to 0.3%, more preferably to 0.2%, even more preferably to 0.1%.

P: 0.001% to 0.05%

P, like Si, has effects of solid solution strengthening and ferrite transformation promotion at the same time. In order to obtain such effects in the present disclosure, it is preferable that the content thereof may be 0.001% or more. When the content thereof is excessive, brittleness due to grain boundary segregation may occur, fine cracks may be likely to occur during a forming operation, and the ductility, stretch flangeability, and impact resistance characteristics may greatly deteriorate. In order to prevent this, an upper limit of the P content is preferably limited to 0.05%, more preferably to 0.03%.

S: 0.01% or less

S may be an impurity inevitably contained in the steel. When the content thereof is excessive, it may forma non-metallic inclusion by bonding with Mn or the like, thereby causing fine cracks to occur during a cutting operation of the steel, and greatly reducing the stretch flangeability and impact resistance. In order to prevent this, an upper limit of the S content is preferably limited to 0.01%, more preferably to 0.005%. In the present disclosure, a lower limit of the S content is not particularly limited. In order to lower the S content to less than 0.001%, it may take too much time for steelmaking to lower productivity thereof. In consideration of the above, the limit may be set to 0.001%.

N: 0.001% to 0.01%

N may be a representative solid solution strengthening element, in addition to C, and may form a coarse precipitate together with Ti, Al, and the like. In order to obtain such effects in the present disclosure, it is preferable that the content thereof may be 0.001% or more. The solid solution strengthening effect of N may be better than that of carbon, but there may be a problem that the toughness may be largely lowered, when the N content in the steel is excessive. In order to prevent this, an upper limit of the N content is preferably limited to 0.01%, more preferably to 0.005%.

Nb: 0.005% to 0.06%

Nb may be a representative precipitation strengthening element, in addition to Ti and V, may precipitate during a hot-rolling operation, and may refine the crystal grains through the delay of recrystallization, thereby improving the strength and impact toughness of the steel. In order to obtain such effects in the present disclosure, the content thereof is preferably 0.005% or more, more preferably 0.01% or more. When the content thereof is excessive, a elongated crystal grain may be formed due to an excessively slow recrystallization delay during hot-rolling, and a coarse complex precipitate may be formed, which may cause a problem of insufficient stretch flangeability. In order to prevent this, an upper limit of the Nb content is preferably limited to 0.06%, more preferably, to 0.04%.

Ti: 0.005% to 0.13%

Ti may be a representative precipitation strengthening element, in addition to Nb and V, and may form a coarse TiN in the steel due to strong affinity with N. Such TiN may serve to inhibit growth of crystal grains during a heating operation for hot-rolling. Ti remaining after the reaction with N may form a TiC precipitate by solid solubilizing in the steel and bonding with C. This TiC may serve to improve the strength of the steel. In order to obtain such an effect in the present disclosure, the content thereof is preferably 0.005% or more, more preferably 0.05% or more. When the content thereof is excessive, the stretch flangeability may deteriorate by the formation of the coarse TiN and the coarsening of the precipitate during a forming operation. In order to prevent this, it is preferable to limit the upper limit of the Ti content to 0.13%.

V: 0.003% to 0.2%

V may be a representative precipitation strengthening element, in addition to Nb and Ti, and may serve to form a precipitate after a coiling operation, to improve the strength of the steel. In order to obtain such effects in the present disclosure, it is preferable that the content thereof may be 0.003% or more. When the content thereof is excessive, a coarse complex precipitate may be formed to deteriorate stretch flangeability, which may be economically disadvantageous. In order to prevent this, an upper limit of the V content is preferably limited to 0.2%, more preferably to 0.15%.

B: 0.0003% to 0.003%

B may have an effect of stabilizing the grain boundaries and improving the brittleness of the steel at low temperature, when it is present in the solid solution state in the steel, and may play a role of forming BN together with solid solution N to inhibit formation of coarse nitride. In order to obtain such an effect in the present disclosure, it is preferable that the content thereof may be 0.0003% or more. When the content thereof is excessive, the recrystallization behavior during a hot-rolling operation may be delayed, and the ferrite transformation may be delayed to reduce the effect of precipitation strengthening. In order to prevent this, an upper limit of the B content is preferably limited to 0.003%, more preferably to 0.002%.

The remainder of the present disclosure may be iron (Fe). In the conventional steel manufacturing process, since impurities which are not intended from raw materials or the surrounding environment may be inevitably incorporated, the impurities may not be excluded. All of these impurities are not specifically mentioned in this specification, as they are known to anyone skilled in the art of steelmaking. Meanwhile, addition of an effective component other than the above-mentioned composition is not excluded.

When designing an alloy of a steel material having the above-described composition range, it is preferable to control [C]* defined by the following Equations 1 and 2 to be 0.022 or more and 0.10 or less, preferably to be 0.022 or more and 0.070 or less, more preferably to be 0.022 or more and 0.045 or less. The [C]* may be calculated by converting the amount of solid solution carbon and nitrogen in the steel. When a value thereof is too low, the bake hardenability may deteriorate. When a value thereof is too high, the burring properties at low temperature may deteriorate:

$$[C]^*=([C]+[N])-([C]+[N])\times S \quad \text{[Equation 1]}$$

$$S=([Nb]/93+[Ti]/48+[V]/51+[Mo]/96)/([C]/12+[N]/14) \quad \text{[Equation 2]}$$

where each of [C], [N], [Nb], [Ti], [V], and [Mo] refers to a weight percentage (wt %) of the element.

In designing an alloy of a steel material having the above-mentioned composition range, the contents of C, N, Nb, Ti, V, and Mo are preferably controlled to be the value of 4.0 or less and more preferably controlled to be the value of 3.95 or less, in which the value calculated by the following Relationship 1. The following Relationship 1 may be a factorization of the combination of alloying elements capable of maintaining the proper formation of martensite and austenite (MA, martensite-austenite constituent) in the steel. The MA in the steel may form a high dislocation density around the steel to increase the bake hardenability of the steel, but, during punching and forming operations of the steel at low temperature, cracks may be generated and propagation of cracks may be promoted, such that the burring properties at low temperature may largely deteriorate. The lower the value of Relationship 1 is, the more favorable the improvement of the burring properties at low temperature. Therefore, the lower limit thereof is not particularly limited in the present disclosure.

$$[Mn]+2.8[Mo]+1.5[Cr]+500[B]\leq 4.0 \quad \text{[Relationship 1]}$$

where each of [Mn], [Mo], [Cr], and [B] refers to a weight percentage (wt %) of the element.

Hereinafter, the microstructure of the high strength multi-phase steel of the present disclosure will be described in detail.

The high strength multi-phase steel of the present disclosure may include ferrite and bainite as microstructures, and the sum of area ratios of ferrite and bainite may be 97 to 99%. When the sum of the area ratios of ferrite and bainite is controlled in the above-described range, strength, ductility, burring properties at low temperature, and bake hardenability of target steel may be easily secured. Each of the area ratio of ferrite and bainite is not particularly limited in the present disclosure.

For example, ferrite may be limited to not less than 20% of the area ratio of ferrite, in view of the fact that the ferrite may be useful for securing ductility of steel and forming fine precipitates, and bainite may be limited to 10% or more of the area ratio of bainite, in view of the fact that the bainite may be useful for securing strength and bake hardenability of steel.

A remainder excluding ferrite and bainite may be martensite and austenite (MA), and the area ratio thereof may be 1 to 3%. When the area ratio of MA is less than 1%, bake hardenability may deteriorate. When the area ratio of MA exceeds 3%, the burring properties at low temperature may deteriorate.

In MA, the austenite may be effective in securing bake hardenability due to high dislocation density formed at the periphery. The austenite may have a higher C content and higher hardness than ferrite or bainite, which may be disadvantageous for the burring properties at low temperature. The coarse austenite having a diameter of 10 μm or more may greatly deteriorate the burring properties at low temperature. Thus, it is preferable to suppress the formation of austenite having a diameter of 10 μm or more, to the maximum. In the present disclosure, the number of austenite structures having a diameter of 10 μm or more per a unit area is limited to $1\times10^4/cm^2$ or less (including $0/cm^2$), and the number of austenite structures having a diameter of less than 10 μm per a unit area is limited to $1\times10^8/cm^2$ or more. In this case, the diameter refers to the equivalent circular diameter of particles detected by observing a cross-section of the steel.

The high strength multi-phase steel of the present disclosure may have an advantage of high tensile strength, and according to an example, the tensile strength may be 590 MPa or more.

The high strength multi-phase steel of the present disclosure may have an advantage of excellent the burring properties at low temperature. According to an example, a product of Hole Expanding Ratio (HER) and tensile strength at −30° C. may be 30,000 MPa·% or more.

The high strength multi-phase steel of the present disclosure may have an advantage of excellent bake hardenability. According to an example, the bake hardenability (BH) may be 40 MPa or more.

The high strength multi-phase steel of the present disclosure described above may be produced by various methods, and the production method thereof is not particularly limited. As a preferable example, it may be produced by the following method.

Hereinafter, a method for producing high strength multi-phase steel excellent in burring properties at low temperature, which may be another aspect of the present disclosure, will be described in detail.

First, a slab having the above-mentioned component system may be reheated.

According to an example, the slab reheating temperature may be 1200° C. to 1350° C. When the reheating temperature is lower than 1200° C., precipitates may be not sufficiently re-dissolved, such that, in other operations after hot-rolling operation, formation of the precipitates may be reduced, and coarse TiN may remain. When the temperature exceeds 1350° C., the strength may be lowered due to abnormal grain growth of the austenite crystal grains.

Next, the reheated slab may be hot-rolled.

According to an example, a hot-rolling operation may be carried out in a temperature range of 850° C. to 1150° C. When the hot-rolling operation is started at a temperature higher than 1150° C., temperature of the hot-rolled steel sheet may become excessively high, size of the crystal grain may become large, and surface quality of the hot-rolled steel sheet may deteriorate. When the hot-rolling operation is terminated at a temperature lower than 850° C., elongated crystal grains may be developed due to excessive recrystallization delay, such that anisotropy may become worse, and formability may also deteriorate.

Next, the hot-rolled steel sheet may be firstly cooled.

In this case, a first cooling end temperature is preferably 500° C. to 700° C., more preferably 600° C. to 670° C. As will be described later, in the present disclosure, an air-cooling operation may be performed after completion of the first cooling operation. In this case, ferrite necessary for ensuring ductility of steel may be formed first, and fine precipitates may be formed in crystal grains of such ferrite. Therefore, the strength of the steel may be secured without affecting burring properties at low temperature. When a first cooling end temperature is too low, fine precipitates may not develop effectively in the subsequent air-cooling operation, to decrease the strength. When a first cooling end temperature is excessively high, ferrite may be not sufficiently developed or MA may be excessively formed, to deteriorate ductility and burring properties at low temperature of the steel.

The cooling rate in the first cooling operation is preferably 10° C./sec to 70° C./sec, more preferably 15° C./sec to 50° C./sec, and more preferably 20° C./sec to 45° C./sec. When the cooling rate is too low, a fraction of the ferrite phase may be too low, while when the cooling rate is too high, the formation of fine precipitates may be insufficient.

Next, the firstly cooled steel sheet may be air-cooled at the first cooling end temperature.

In this case, air-cooling time is preferably 3 to 10 seconds. When the air-cooling time is too short, the ferrite may not be sufficiently formed to deteriorate ductility. When air-cooling time is too long, bainite may be not sufficiently formed, to deteriorate the strength and the bake hardenability.

Next, the air-cooled steel sheet may be secondly cooled.

In this case, a second cooling end temperature is preferably 400° C. to 550° C., more preferably 450° C. to 550° C. When the second cooling end temperature is too high, bainite may not be sufficiently formed, and the strength of steel may be difficult to secure. When the second cooling end temperature is excessively low, bainite in the steel may be formed in excessively larger amounts than necessary, to greatly reduce the ductility, and MA may be also formed to deteriorate the burring properties at low temperature.

A cooling rate in the second cooling operation is preferably 10° C./sec to 70° C./sec, more preferably 15° C./sec to 50° C./sec, and still more preferably 20° C./sec to 25° C./sec. When the cooling rate is too low, crystal grain of a matrix structure may become coarse, and a microstructure may become ununiform. When the cooling rate is too high, MA may be likely to be formed, to deteriorate the burring properties at low temperature.

Next, the secondly cooled hot-rolled steel sheet may be coiled at the second cooling end temperature, and then may be subjected to a third cooling operation.

In the third cooling operation, a cooling rate is preferably 25° C./hour or less (excluding 0° C./hour) and more preferably 10° C./hour or less (excluding 0° C./hour). When the cooling rate is excessively high, MA in the steel may be formed in a large amount, to deteriorate the burring properties at low temperature. The slower the cooling rate in the third cooling operation, the more favorable the inhibition of MA formation in the steel. In the present disclosure, a lower limit thereof is not particularly limited. In order to control the cooling rate to less than 0.1° C./hour, a separate heating facility and the like may be needed, which may be economically disadvantageous. Considering this, the lower limit may be limited to 0.1° C./hour.

In the present disclosure, a third cooling end temperature is not particularly limited, and it may be enough when a third cooling operation is maintained until a temperature at which phase transformation of the steel is completed. By way of non-limiting example, the third cooling end temperature may be below 200° C.

MODE FOR INVENTION

In the description below, an example embodiment of the present disclosure will be described in greater detail. It should be noted that the example embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

Example

Steel slabs having the compositions illustrated in the following Tables 1 and 2 were reheated to 1250° C., and were hot-rolled under the conditions illustrated in Table 2 to obtain hot-rolled steel sheets. Then, a first cooling operation, an air-cooling operation, a second cooling operation, a coiling operation, and a third cooling operation were carried out in sequence. In each example, first and second cooling rates were in the range of 20° C./sec to 25° C./sec, a first cooling end temperature was 650° C., and air-cooling time was constantly 5 seconds. In the following Table 3, FDT refers to a hot-rolling end temperature, and CT refers to a second cooling end temperature (coiling temperature).

Then, a microstructure of the hot-rolled steel sheet was analyzed, and mechanical properties were evaluated. The results therefrom are illustrated in the following Table 4.

In the following Table 4, an area fraction of MA in steel was measured using an optical microscope and an image analyzer after etched by Lepera etching method. The size and number of austenite structures were measured using an Electron Back Scatter Diffraction (EBSD) method, and analyzed at 3000 magnification.

In the following Table 4, YS, TS, and T-El refer to 0.2% off-set yield strength, tensile strength, and fracture elongation, respectively, and were test results of JIS No. 5 standard test specimens taken in a direction perpendicular to a rolling direction. In addition, the HER evaluation was based on the JFST 1001-1996 standard, and was averaged after three runs. In this case, the HER evaluation results at room temperature and −30° C. were the results of punching and hole expansion tests of initial holes at 25° C. and −30° C., respectively. BH was a test result of a tensile test specimen of JIS standard (JIS No. 5) manufactured in a direction perpendicular to a rolling direction, and was subjected to 2% tensile strain, heat treated at 170° C. for 20 minutes, and a tensile test was carried out, and BH is a difference between measured lower yield strength value or 0.2% offset yield strength value in tension test and measured strength value in 2% tensile strain.

TABLE 1

| | Alloy Composition (wt %) | | | | | | | |
|---|---|---|---|---|---|---|---|---|
| Example | C | Si | Mn | Cr | Al | P | S | N |
| *CE1 | 0.045 | 0.03 | 1.4 | 0.01 | 0.03 | 0.01 | 0.003 | 0.004 |
| CE2 | 0.06 | 0.3 | 1.3 | 0.05 | 0.03 | 0.01 | 0.003 | 0.003 |
| CE3 | 0.07 | 0.01 | 1.8 | 0.8 | 0.03 | 0.01 | 0.003 | 0.004 |
| CE4 | 0.07 | 0.5 | 2.1 | 0.5 | 0.04 | 0.01 | 0.002 | 0.005 |
| CE5 | 0.13 | 0.1 | 1.8 | 0.01 | 0.04 | 0.01 | 0.003 | 0.003 |
| CE6 | 0.08 | 0.02 | 2.2 | 0.6 | 0.03 | 0.01 | 0.003 | 0.004 |
| CE7 | 0.125 | 0.3 | 2.6 | 0.5 | 0.03 | 0.01 | 0.003 | 0.004 |
| CE8 | 0.06 | 0.1 | 2.4 | 0.5 | 0.03 | 0.01 | 0.003 | 0.003 |
| CE9 | 0.06 | 0.1 | 2.4 | 0.5 | 0.03 | 0.01 | 0.003 | 0.003 |
| **IE1 | 0.06 | 0.05 | 1.3 | 0.5 | 0.03 | 0.01 | 0.003 | 0.004 |
| IE2 | 0.06 | 0.01 | 1.5 | 0.01 | 0.03 | 0.01 | 0.003 | 0.0042 |
| IE3 | 0.05 | 0.9 | 1.7 | 0.7 | 0.03 | 0.01 | 0.003 | 0.0035 |
| IE4 | 0.07 | 0.3 | 1.6 | 0.7 | 0.03 | 0.01 | 0.003 | 0.004 |

TABLE 1-continued

| | Alloy Composition (wt %) | | | | | | | |
|---|---|---|---|---|---|---|---|---|
| Example | C | Si | Mn | Cr | Al | P | S | N |
| IE5 | 0.075 | 0.7 | 1.7 | 0.7 | 0.03 | 0.01 | 0.003 | 0.004 |
| IE6 | 0.06 | 0.1 | 2.4 | 0.5 | 0.03 | 0.01 | 0.003 | 0.003 |

*CE: Comparative Example,

**IE: Inventive Example.

TABLE 2

| | Alloying Composition (wt %) | | | | | | |
|---|---|---|---|---|---|---|---|
| Example | Mo | Ti | Nb | V | B | [C]* | Relationship 1 |
| *CE1 | 0.03 | 0.09 | 0.03 | 0.005 | 0.0002 | 0.017 | 1.60 |
| CE2 | 0.1 | 0.004 | 0.05 | 0.1 | 0.0003 | 0.019 | 1.81 |
| CE3 | 0.15 | 0.09 | 0.025 | 0.005 | 0.0015 | 0.028 | 4.17 |
| CE4 | 0.1 | 0.1 | 0.03 | 0.006 | 0.0025 | 0.032 | 4.38 |
| CE5 | 0.001 | 0.07 | 0.02 | 0.005 | 0.0004 | 0.051 | 2.02 |
| CE6 | 0.2 | 0.04 | 0.06 | 0.1 | 0.001 | 0.017 | 4.16 |
| CE7 | 0.05 | 0.06 | 0.007 | 0.008 | 0.0015 | 0.049 | 4.38 |
| CE8 | 0.004 | 0.07 | 0.03 | 0.004 | 0.0015 | 0.040 | 3.91 |
| CE9 | 0.004 | 0.07 | 0.03 | 0.004 | 0.0015 | 0.040 | 3.91 |
| **IE1 | 0.005 | 0.085 | 0.02 | 0.005 | 0.0003 | 0.038 | 2.21 |
| IE2 | 0.003 | 0.07 | 0.03 | 0.005 | 0.0004 | 0.041 | 1.72 |
| IE3 | 0.05 | 0.06 | 0.03 | 0.005 | 0.0005 | 0.027 | 3.14 |
| IE4 | 0.004 | 0.1 | 0.02 | 0.005 | 0.0004 | 0.045 | 2.86 |
| IE5 | 0.004 | 0.11 | 0.02 | 0.1 | 0.0004 | 0.024 | 2.96 |
| IE6 | 0.004 | 0.07 | 0.03 | 0.004 | 0.0015 | 0.040 | 3.91 |

*CE: Comparative Example,

**IE: Inventive Example.

TABLE 3

| Steel | FDT (° C.) | CT (° C.) | $3^{rd}$ Cooling Rate (° C./h) |
|---|---|---|---|
| *CE1 | 904 | 520 | 5.5 |
| CE2 | 887 | 495 | 3.8 |
| CE3 | 899 | 485 | 11 |
| CE4 | 884 | 455 | 4 |
| CE5 | 885 | 490 | 15 |
| CE6 | 902 | 470 | 5 |
| CE7 | 895 | 504 | 1.5 |
| CE8 | 905 | 580 | 12.5 |
| CE9 | 899 | 465 | 63 |
| **IE1 | 896 | 455 | 8.2 |
| IE2 | 901 | 448 | 5.5 |
| IE3 | 905 | 452 | 3.5 |
| IE4 | 899 | 465 | 10.5 |
| IE5 | 899 | 465 | 8 |
| IE6 | 911 | 477 | 2.5 |

*CE: Comparative Example,

**IE: Inventive Example.

TABLE 4

| | Microstructure | | | | | Mechanical Properties | | | | | |
|---|---|---|---|---|---|---|---|---|---|---|---|
| | Area Ratio (%) | | | Number of A | | | | | | HER (%) | |
| Steel | F | B | MA | Diameter less than 10 μm | Diameter 10 μm or more | YS (MPa) | TS (MPa) | T-El (%) | BH (MPa) | Room Temp. | −30° C. |
| CE1 | 88 | 11 | 1 | $8.6 \times 10^6$ | $1.2 \times 10^3$ | 534 | 616 | 19 | 23 | 62 | 52 |
| CE2 | 80 | 18 | 2 | $3.8 \times 10^7$ | $3.7 \times 10^3$ | 521 | 599 | 19 | 26 | 67 | 55 |
| CE3 | 62 | 34 | 4 | $5.1 \times 10^8$ | $6.5 \times 10^4$ | 720 | 815 | 18 | 45 | 46 | 21 |
| CE4 | 59 | 37 | 4 | $7.6 \times 10^8$ | $8.4 \times 10^4$ | 766 | 875 | 11 | 52 | 32 | 17 |
| CE5 | 42 | 46 | 12 | $8.2 \times 10^{10}$ | $9.2 \times 10^7$ | 723 | 967 | 11 | 53 | 28 | 15 |
| CE6 | 60 | 36 | 4 | $2.1 \times 10^9$ | $3.2 \times 10^5$ | 869 | 988 | 10 | 35 | 34 | 18 |
| CE7 | 54 | 38 | 8 | $6.2 \times 10^{10}$ | $9.7 \times 10^6$ | 805 | 992 | 10 | 48 | 26 | 12 |
| CE8 | 92 | 5 | 0 | $3.8 \times 10^3$ | 0 | 655 | 720 | 18 | 5 | 33 | 15 |
| CE9 | 72 | 25 | 3 | $2.6 \times 10^9$ | $8.5 \times 10^4$ | 859 | 995 | 10 | 58 | 44 | 19 |
| IE1 | 82 | 17 | 1 | $7.3 \times 10^8$ | $4.8 \times 10^3$ | 622 | 705 | 18 | 52 | 68 | 56 |
| IE2 | 79 | 20 | 1 | $6.1 \times 10^8$ | $6.6 \times 10^2$ | 586 | 655 | 19 | 56 | 75 | 63 |
| IE3 | 73 | 25 | 2 | $2.2 \times 10^8$ | $8.7 \times 10^3$ | 723 | 824 | 17 | 43 | 54 | 48 |
| IE4 | 68 | 31 | 1 | $7.3 \times 10^8$ | $6.1 \times 10^3$ | 718 | 815 | 18 | 46 | 52 | 45 |
| IE5 | 61 | 36 | 3 | $5.2 \times 10^8$ | $4.6 \times 10^3$ | 803 | 905 | 14 | 47 | 46 | 40 |
| IE6 | 23 | 75 | 2 | $6.9 \times 10^8$ | $9.2 \times 10^3$ | 867 | 1003 | 10 | 52 | 45 | 35 |

*In the microstructure, F refers to ferrite, B refers to bainite, and A refers to austenite.
*CE: Comparative Example,
**IE: Inventive Example.@

In Comparative Examples 1 and 2, the desired BH value in the present disclosure was not obtained, because [C]* values obtained therefrom failed to fall within the range of the present disclosure. In Comparative Examples 3 and 4, not satisfying Relationship 1, it was confirmed that MA phase in steel was excessively formed, and burring properties at low temperature deteriorated. In Comparative Example 5, a [C]* value obtained therefrom failed to fall within the range of the present disclosure, and a high BH value was obtained, but yield strength was decreased and burring properties at low temperature deteriorated. This was because the MA phase increased. In Comparative Examples 6 and 7, [C]* values obtained therefrom and a value of Relationship 1 were not all satisfied. In Comparative Example 6, due to lack of excess C and N, BH value was low, and alloying elements, capable of increasing hardenability, were in an excessive amount to also deteriorate HER at low temperature. In Comparative Example 7, it was evaluated that the MA phase increased to have a high BH value, due to excess C in the steel, but to have low burring properties at low temperature.

In Comparative Examples 8 and 9, all of the component range proposed in the present disclosure, a [C]* value, and a value of Relationship 1 were satisfied, but coiling temperature or cooling rate after coiling failed to fall within the range proposed by the present disclosure. In Comparative Example 8, coiling temperature was as high as 580° C., to have a lower bainite phase fraction in the microstructure, and MA phase was hardly produced. In this case, coarse carbides were observed near the grain boundaries. As a result, BH value was very low, and burring properties at low temperature also deteriorated. In Comparative Example 9, since a forced cooling operation was performed after coiling, third cooling rate was 63° C./hour. In Comparative Example 9, it was confirmed that MA phase fraction in the microstructure was slightly high, and, in particular, a somewhat larger austenite phase having a diameter of 10 μm or more was formed. It was judged that this was due to a high cooling rate after coiling, and a high BH value was obtained, but burring properties at low temperature deteriorated.

All of the inventive examples satisfied all of composition ranges, manufacturing conditions, a [C]*value, and a value of Relationship 1 value proposed in the present disclosure, to secure all of the desired materials.

FIG. 1 is a graph showing relationships between tensile strength and Hole Expanding Ratio (HER) of Inventive Examples 1 to 6 and Comparative Examples 1 to 7. In all of the inventive examples satisfying the conditions proposed in the present disclosure, a product of Hole Expanding Ratio (HER) and tensile strength at −30° C. was 30,000 MPa·% or more.

While example embodiments have been illustrated and described above, it will be apparent to those skilled in the art that modifications and variations could be made without departing from the scope of the present invention as defined by the appended claims.

The invention claimed is:

1. A multi-phase steel comprising: by weight, carbon (C): 0.05% to 0.14%, silicon (Si): 0.01% to 1.0%, manganese (Mn): 1.0% to 3.0%, aluminum (Al): 0.01% to 0.1%, chromium (Cr): 0.005% to 1.0%, molybdenum (Mo): 0.003% to 0.3%, phosphorus (P): 0.001% to 0.05%, sulfur (S): 0.01% or less, nitrogen (N): 0.001% to 0.01%, niobium (Nb): 0.005% to 0.06%, titanium (Ti): 0.005% to 0.13%, vanadium (V): 0.003% to 0.2%, boron (B): 0.0003% to 0.003%, a remainder of iron (Fe), and other inevitable impurities, wherein [C]* defined by the following Equations 1 and 2 is 0.022 or more and 0.10 or less, and the following Relationship 1 is satisfied, $$[C]^*=([C]+[N])-([C]+[N])\times S \quad \text{[Equation 1]}$$

$$S=([Nb]/93+[Ti]/48+[V]/51+[Mo]/96)/([C]/12+[N]/14) \quad \text{[Equation 2]}$$

$$[Mn]+2.8[Mo]+1.5[Cr]+500[B]\leq 4.0 \quad \text{[Relationship 1]}$$

where each of [C], [N], [Nb], [Ti], [V], [Mn], [Cr], [B], and [Mo] refers to a weight percentage (wt %) of respective elements;

a microstructure comprising: ferrite; bainite; and martensite-austenite (MA) constituents;

a yield strength of 560 MPa or more; and a bake hardenability (BH) of 40 MPa or more, wherein a sum of area ratios of the ferrite and the bainite is 97% to 99%, and an area ratio of the martensite-austenite (MA) constituents is 1% to 3%, wherein an area ratio of the ferrite is 20% or more, and an area ratio of the bainite is 17% or more, and wherein, in the martensite-austenite (MA) constituents, a number of austenite structures having a diameter of 10 μm or more is $1\times10^4/cm^2$ or less, including $0/cm^2$, and a number of austenite structures having a diameter of less than 10 μm is $1\times10^8/cm^2$ or more.

2. The multi-phase steel according to claim 1, wherein a product of hole expanding ratio (HER) and tensile strength of the multi-phase steel at −30° C. is 30,000 MPa·% or more.

* * * * *